US009936856B1

(12) United States Patent
Eilmus et al.

(10) Patent No.: US 9,936,856 B1
(45) Date of Patent: Apr. 10, 2018

(54) WINE GLASS DRYING RACK

(71) Applicant: Kohler Co., Kohler, WI (US)

(72) Inventors: Niels J. Eilmus, Sheboygan, WI (US); Ryan R. Detlaff, Sheboygan, WI (US); James S. Giefer, Sheboygan, WI (US); Evan M. Grybush, Kiel, WI (US); Zeke Semirario, Portland, OR (US)

(73) Assignee: KOHLER CO., Kohler, WI (US)

( * ) Notice: Subject to any disclaimer, the term of this patent is extended or adjusted under 35 U.S.C. 154(b) by 0 days.

(21) Appl. No.: 15/365,269

(22) Filed: Nov. 30, 2016

(51) Int. Cl.

| | |
|---|---|
| ***A47L 19/04*** | (2006.01) |
| ***A47G 23/02*** | (2006.01) |
| ***A47B 73/00*** | (2006.01) |
| ***A47B 81/04*** | (2006.01) |

(52) U.S. Cl.
CPC ..... *A47L 19/04* (2013.01); *A47B 73/002* (2013.01); *A47B 81/04* (2013.01); *A47G 23/0208* (2013.01)

(58) Field of Classification Search
CPC ..... A47L 19/04; A47L 19/00; A47G 23/0208; A47B 73/002; A47B 81/04
USPC ..... 211/74
See application file for complete search history.

(56) References Cited

U.S. PATENT DOCUMENTS 1,714,629 A * 5/1929 Rodin ..... A47L 19/04 211/195
2,443,404 A * 6/1948 Domiano ..... A47L 19/02 211/41.4
2,958,424 A * 11/1960 Bigatti ..... A47L 19/00 211/104
6,502,704 B2 * 1/2003 Martorella ..... A47L 19/04 211/41.5
7,063,219 B2 * 6/2006 Fann ..... A47B 73/002 211/126.15
7,228,975 B2 * 6/2007 Yang ..... A47L 19/04 211/41.4
7,407,059 B2 * 8/2008 Sullivan ..... A47L 19/04 211/41.3
7,455,184 B2 * 11/2008 Yang ..... A47L 19/04 211/41.4
7,850,017 B2 * 12/2010 McCain ..... A47B 73/002 211/74
8,925,742 B1 * 1/2015 Chitayat ..... A47L 19/04 211/132.1
9,301,671 B2 * 4/2016 Jarl ..... A47B 81/04
(Continued)

FOREIGN PATENT DOCUMENTS

FR 730779 A * 8/1932 ..... A47L 19/04
FR 785668 A * 8/1935 ..... A47L 19/04
(Continued)

*Primary Examiner* — Stanton L Krycinski
(74) *Attorney, Agent, or Firm* — Foley & Lardner LLP

(57) ABSTRACT

Systems and methods of using a wine glass drying assembly. The wine glass drying rack assembly includes a tray with a bottom, sides, and a vertical lock. The wine glass drying rack assembly further includes a support with a locking element, stems and a top extending between the stems, where the support is coupled to the vertical lock via the locking element and where the support is rotatable about the vertical lock of the tray. The wine glass assembly also includes a rack with two wine glass supports, where the two wine glass supports define a slot for receiving wine glasses, where the rack is coupled to the top of the support via loops and where the rack is rotatable about the top of the support.

11 Claims, 8 Drawing Sheets

(56) References Cited

U.S. PATENT DOCUMENTS

| | | | | |
|---|---|---|---|---|
| 2008/0283480 | A1* | 11/2008 | Segall | A47L 19/02 211/41.6 |
| 2009/0255888 | A1* | 10/2009 | Melvin | A47L 15/505 211/85.29 |
| 2013/0105423 | A1* | 5/2013 | Chalifoux | A47J 47/005 211/41.5 |

FOREIGN PATENT DOCUMENTS

| | | | | |
|---|---|---|---|---|
| FR | 2109651 | A7 * | 5/1972 | A47L 19/04 |
| GB | GB-546208 | A * | 7/1942 | A47L 19/04 |

* cited by examiner

WINE GLASS DRYING RACK

BACKGROUND

The present disclosure relates generally to the field of drying racks. Specifically, the present disclosure relates to a collapsible wine glass drying rack.

SUMMARY

One embodiment relates to a wine glass drying rack assembly. The wine glass drying rack assembly includes a tray with a bottom, sides, and a vertical lock. The wine glass drying rack assembly further includes a support with a locking element, stems and a top extending between the stems, where the support is coupled to the vertical lock via the locking element and where the support is rotatable about the vertical lock of the tray. The wine glass assembly also includes a rack with two wine glass supports, where the two wine glass supports define a slot for receiving wine glasses, where the rack is coupled to the top of the support via loops and where the rack is rotatable about the top of the support.

Another embodiment relates to a wine glass drying rack assembly. The wine glass drying rack assembly includes a tray with a top, sides, and a vertical lock. The wine glass drying rack assembly also includes a support with stems and a first support member extending between the stems, where the stems are coupled to the vertical lock via a pin and the support is rotatable about the vertical lock of the tray. The wine glass drying rack assembly further includes a rack with a second support member and at least two glass supports extending from the second support member, where the two glass supports define a slot for receiving wine glasses, where the rack is coupled to the first support member of the support via a pin and where the rack is rotatable about the first support member of the support.

The foregoing summary is illustrative only and is not intended to be in any way limiting. In addition to the illustrative aspects, embodiments, and features described above, further aspects, embodiments, and features will become apparent by reference to the drawings and the following description.

BRIEF DESCRIPTION OF THE DRAWINGS

Further features, characteristics, and advantages of the present disclosure will become apparent to a person of ordinary skill in the art from the following detailed description of embodiments of the present disclosure, made with reference to the drawings annexed, in which like reference characters refer to like elements.

DETAILED DESCRIPTION

Various aspects of the disclosure will now be described with regard to certain examples and embodiments, which are intended to illustrate but not to limit the disclosure. Nothing in this disclosure is intended to imply that any particular feature or characteristic of the disclosed embodiments is essential. The scope of protection is not defined by any particular embodiment described herein. Before turning to the figures, which illustrate exemplary embodiments in detail, it should be understood that the application is not limited to the details or methodology set forth in the description or illustrated in the figures. It should also be understood that the terminology is for the purpose of the descriptions only and should not be regarded as limiting.

Generally speaking, some wine glass drying racks are bulky to store, difficult to assemble, or allow water dripping from the wine glasses to land directly on a surface where the wine glass drying rack is located.

Accordingly, referring generally to the figures, disclosed herein are assemblies for a collapsible wine glass drying rack that is compact and easy to use.

Figure 1A:
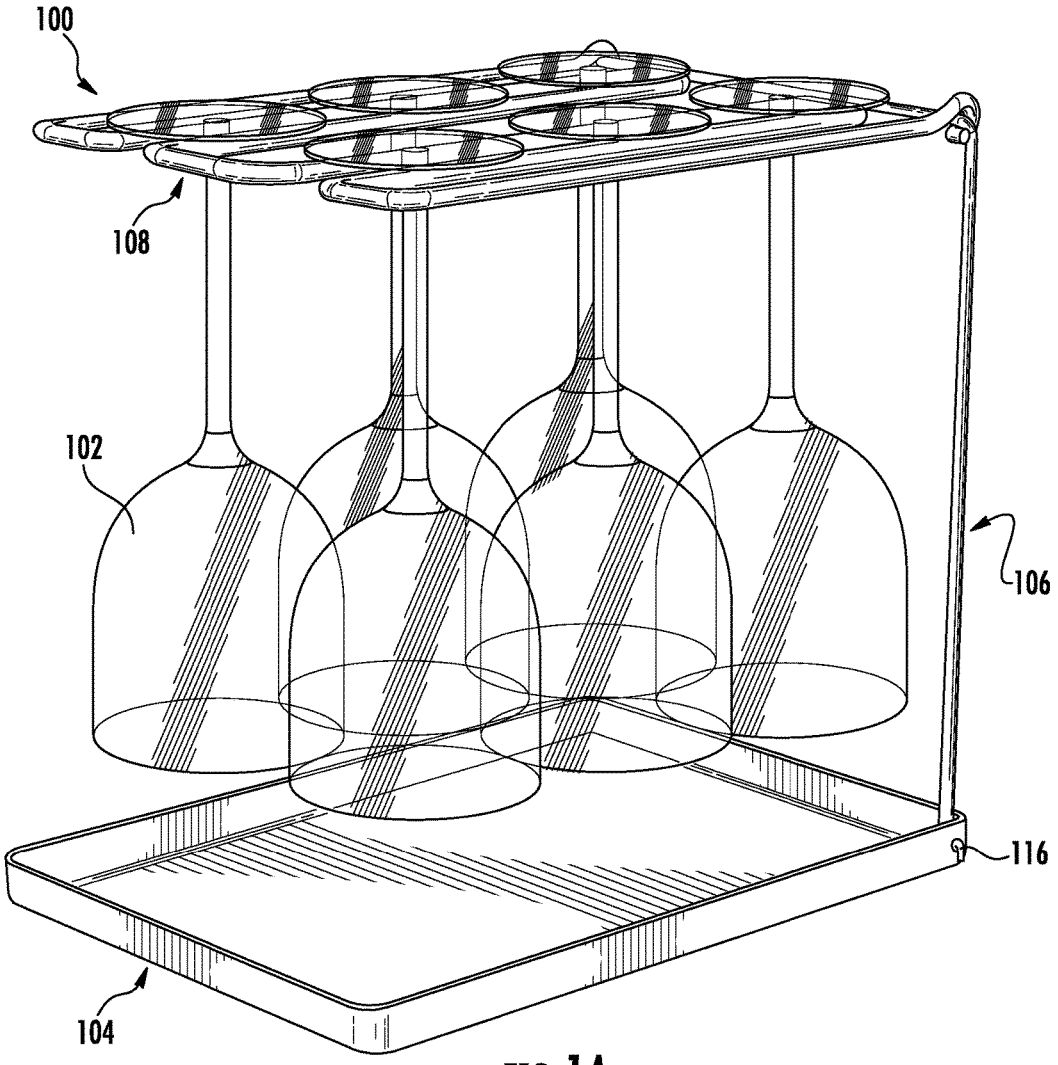
FIG. 1A is a perspective view of a wine glass drying rack in an open position holding wine glasses, according to an exemplary embodiment.

Referring to FIG. 1A, a perspective view of a wine glass drying rack 100 in an open position holding wine glasses 102 is shown, according to an exemplary embodiment. Wine glass drying rack 100 includes a tray 104, a support 106 and a rack 108 to facilitate drying wine glasses 102. In some embodiments, the wine glass drying rack 100 can hang up to six wine glasses 102. In some embodiments, the wine glass drying rack 100 can hang more than six wine glasses 102.

Figure 1B:
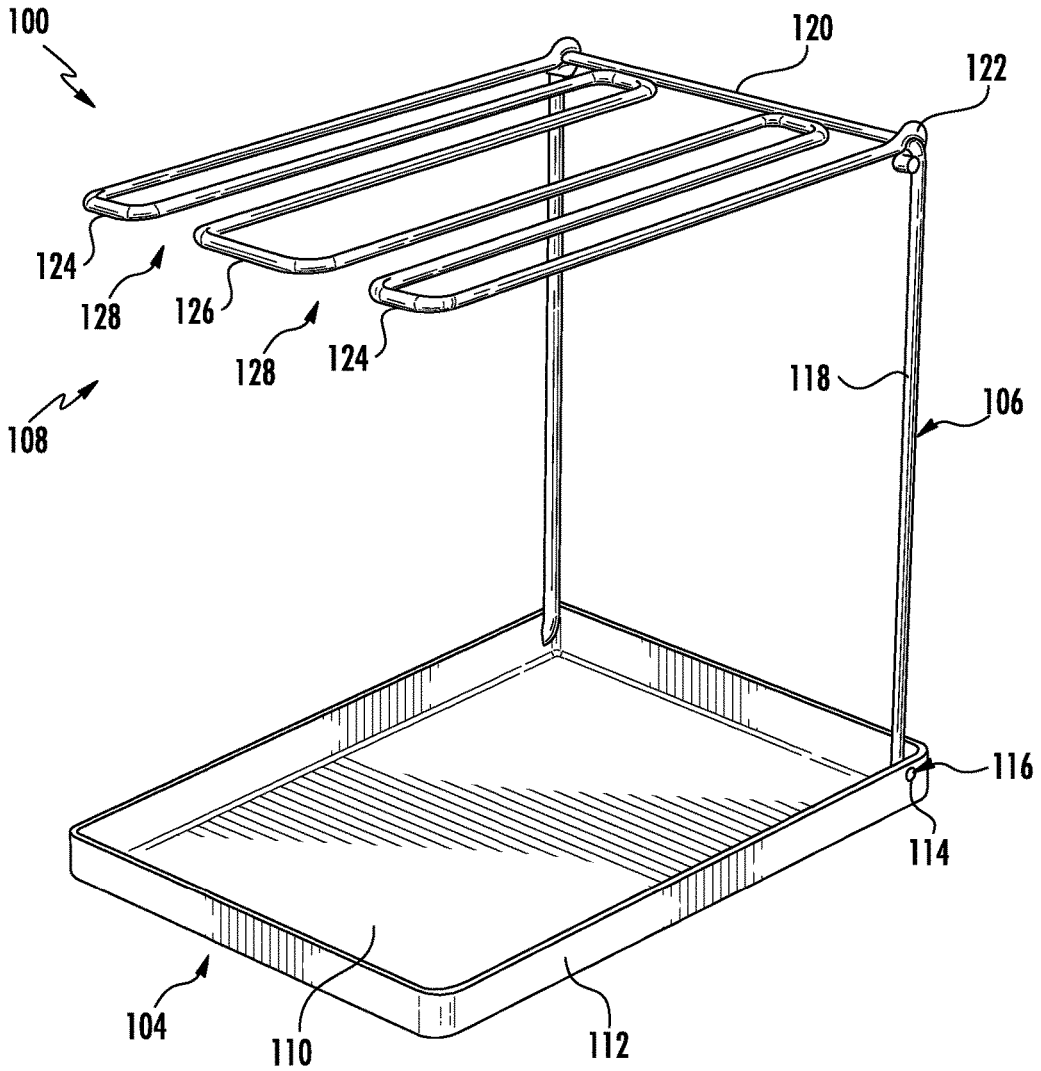
FIG. 1B is a perspective view of a wine glass drying rack in an open position without wine glasses, according to the exemplary embodiment of FIG. 1A.
Figure 1C:
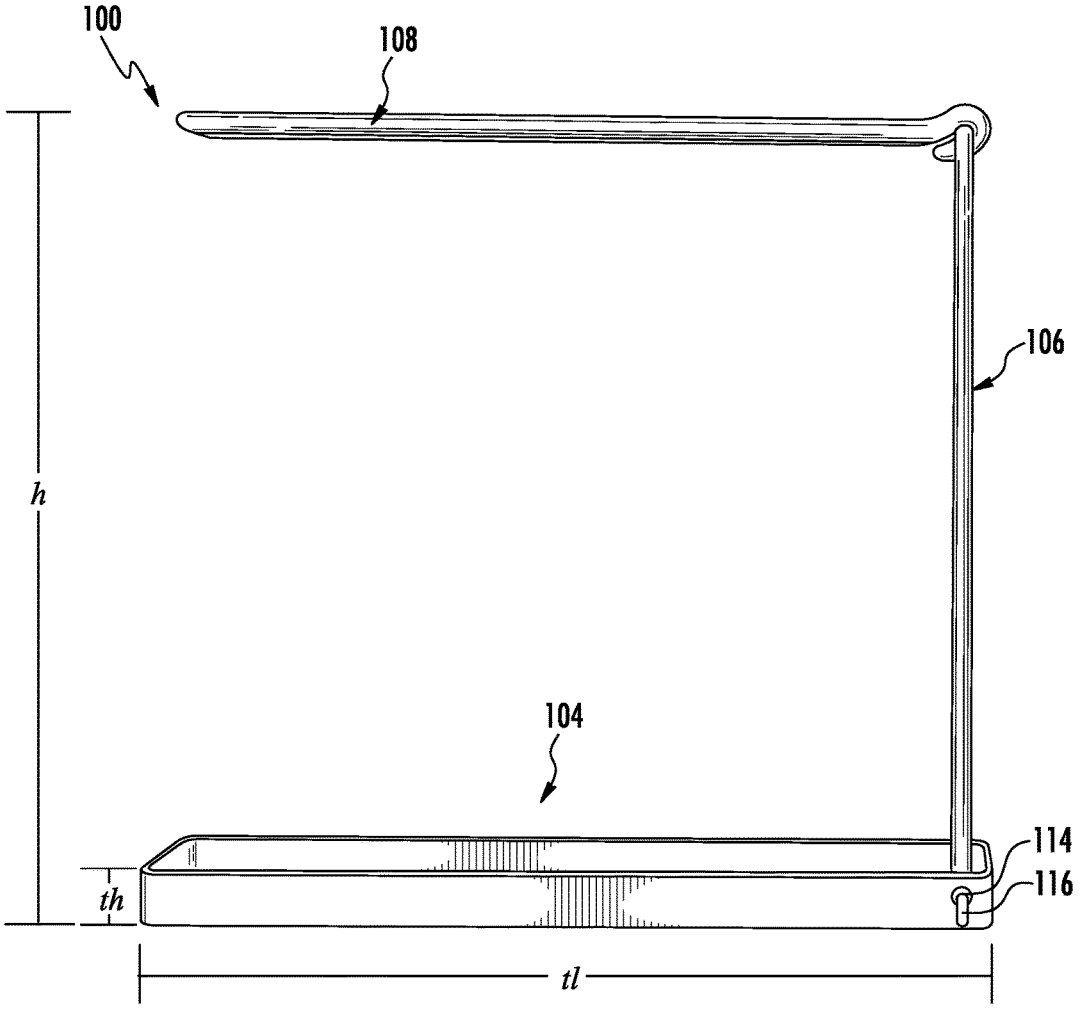
FIG. 1C is a side view of a wine glass drying rack in an open position without wine glasses, according to the exemplary embodiment of FIG. 1A.

Referring now to FIGS. 1B and 1C, the wine glass drying rack 100 is shown in an open position without wine glasses 102, according to an exemplary embodiment. In the open position, the tray 104, the support 106 and the rack 108 are all positioned to hold wine glasses 102. The wine glasses 102 hang from rack 108, which is shown in a horizontal orientation. The rack 108 is held in place by support 106, which also vertically separates rack 108 from tray 104. Tray 104 provides a base for the wine glass drying rack 100 and may store the rack 108 and support 106 when in a closed position. The rack 108 is rotatably coupled to the support 106 at an upper joint shown as loops 122. The support 106 is rotatably coupled to the tray 104, which is stationary. Due to the rotatable connection between the support 106 and the rack 108, the rack 108 is also rotatably coupled to the tray 104 via the support 106. The coupling between the rack 108, the support 106 and the tray 104 allows the wine glass drying rack 100 to move between an open position that allows wine glasses 102 to be hung, and a closed position that allows the wine glass drying rack 100 to be stored compactly.

The tray 104 may be made of polypropolyne, silicone overmolded onto a carbon steel, or another type of plastic, steel or a combination thereof. Tray 104 is shown to include a tray bottom 110 and tray sides 112. In some embodiments, the tray bottom 110 and tray sides 112 may be approximately 0.125 inches thick when made of polypropolyne. In some embodiments, the tray bottom 110 and tray sides 112 may be greater than 0.125 inches thick when made of a material with a silicone overmold. In some embodiments, if the tray 104 is polypropolyne, an underside of the tray bottom 110 may include a thermoplastic elastomer (TPE) or silicone pad to prevent sliding of the tray 104. In some embodiments, the underside of the tray bottom 110 may be textured to prevent sliding of the tray 104. The tray bottom 110 may be sized such that it has a length (tl) and a width. The tray length (tl), tray width, and a tray height (th) of the tray sides 112 may be sized such that when the wine glass drying rack 100 is in a closed position, the support 106 and the rack 108 can fit within the tray sides 112 that surround the tray bottom 110. In some embodiments, the tray length (tl) may be approximately 10 inches. In some embodiments, the tray sides 112 may have a tray height (th) of approximately 0.75 inches. In some embodiments, the tray sides 112 have a tray height (th) such that when the wine glass drying rack 100 is in the closed position, the rack 108 and support 106 do not extend above the tray height (th). In some embodiments, the tray 104 also includes a draining spout (not shown). The draining spout may facilitate removal of water from the tray 104 into a sink. In some embodiments, the tray bottom 110 may have an angle, slope, channels, etc. to facilitate movement of water towards the draining spout.

The tray 104 is also shown to include vertical locks 114. Vertical locks 114 are located near a rear portion of the tray 104. Vertical locks 114 couple with the support 106 and allow rotation of the support 106 about the vertical locks 114. The vertical locks 114 also lock the support 106 in an upright position when the wine glass drying rack 100 is in the open position. In some embodiments, the vertical locks 114 include a detent that catches the support 106 and secures the support 106 until released. In some embodiments, the vertical lock 114 may include two apertures that are connected. A first aperture may be sized to allow the support 106 to rotate within the first aperture. The second aperture may be sized to prevent rotation of the support 106 within the second aperture. In some embodiments, the support 106 can move in a first and second direction within the vertical lock 114. When moved in the first direction, the support 106 may be locked into place in the second aperture and when moved in the second direction, the support 106 may be moved into the first aperture and rotatable within the first aperture. However, other locking mechanisms may be used as well.

The support 106 includes a locking piece 116 on both sides of the support 106 to couple the support 106 to the vertical locks 114. Locking element 116 may extend through the apertures of vertical locks 114 and include a cap, bend or other configuration that secures the support 106 onto the tray 104 within the vertical locks 114. In some embodiments, the support 106 is removable from the tray 104. The support 106 also includes stems 118 that define a vertical height between the rack 108 and the tray 104. The support 106 is shown to include two stems 118, however, more stems may be used. When locked in an upright position, a height (h) of the wine glass drying rack 100 may be approximately 9.875 inches. The height (h) of the stem 118 should be determined such that when in the closed position, the support 106 can fit within the tray 104. The support 106 also includes a top 120 that extends horizontally between the stems 118. The top 120 of support 106 couples to the rack 108. The support 106 may be a single unit, or may be multiple pieces coupled together.

Rack 108 is shown to include loops 122, end supports 124, middle support 126 and slots 128. Loops 122 couple the rack 108 to the support 106 and allow the rack 108 to rotate about the top 120 of support 106 to move from the closed position to the open position and vice-versa. The loops 122 use physical interference to maintain the rack 108 in a horizontal orientation when in the open position. In some embodiments, the loops 122 extend around the support 106 and include a bend extending away from the rack 108 and extending toward the stems 118 such that the bend abuts the stem 118 when the rack 108 is rotated around the top 120 of the support 106, preventing additional movement of the rack 108 around the support 106 once the rack 108 has reached a substantially horizontal position. The rack 108 extends away from loops 122 on both sides to create end supports 124. The end supports 124 provide a structure to hold a first portion of a base of the wine glasses 102. The end supports 124 may be located such that each end support 124 supports half of the maximum number of wine glasses 102 that can be dried with the wine glass drying rack 100. The end supports 124 may have an elongated U shape with a bottom of the U away from the top 120 of the support 106. Corners of the end supports 124 and middle support 126 may be square or rounded. The rack 108 also includes a middle support 126. Middle support 126 provides a structure to hold a second portion of the base of the wine glasses 102 opposite the first portion supported by the end supports 124. Middle support 126 may provide support for all the wine glasses 102 that can be dried with the wine glass drying rack 100. The middle support 126 may have an elongated U shape that is approximately two times wider than the end supports 124. The end supports 124 and middle support 126 define slots 128. Slots 128 allow stems of wine glasses 102 to enter between the end supports 124 and middle support 126 to allow the base of wine glasses 102 to rest on the end supports 124 and middle support 126. In some embodiments, the rack 108 defines two slots, as shown, however more or less slots may be created depending on the number of end supports 124 and middle supports 126. The end supports 124 and the middle support 126 may be formed such that the end supports 124 and the middle support 126 are connected and/or made from a single piece of wire that oscillates toward and away from top 120. In some embodiments, the support 106 and the rack 108 are made of electro-polished stainless steel, though other materials may be used.

Figure 1D:
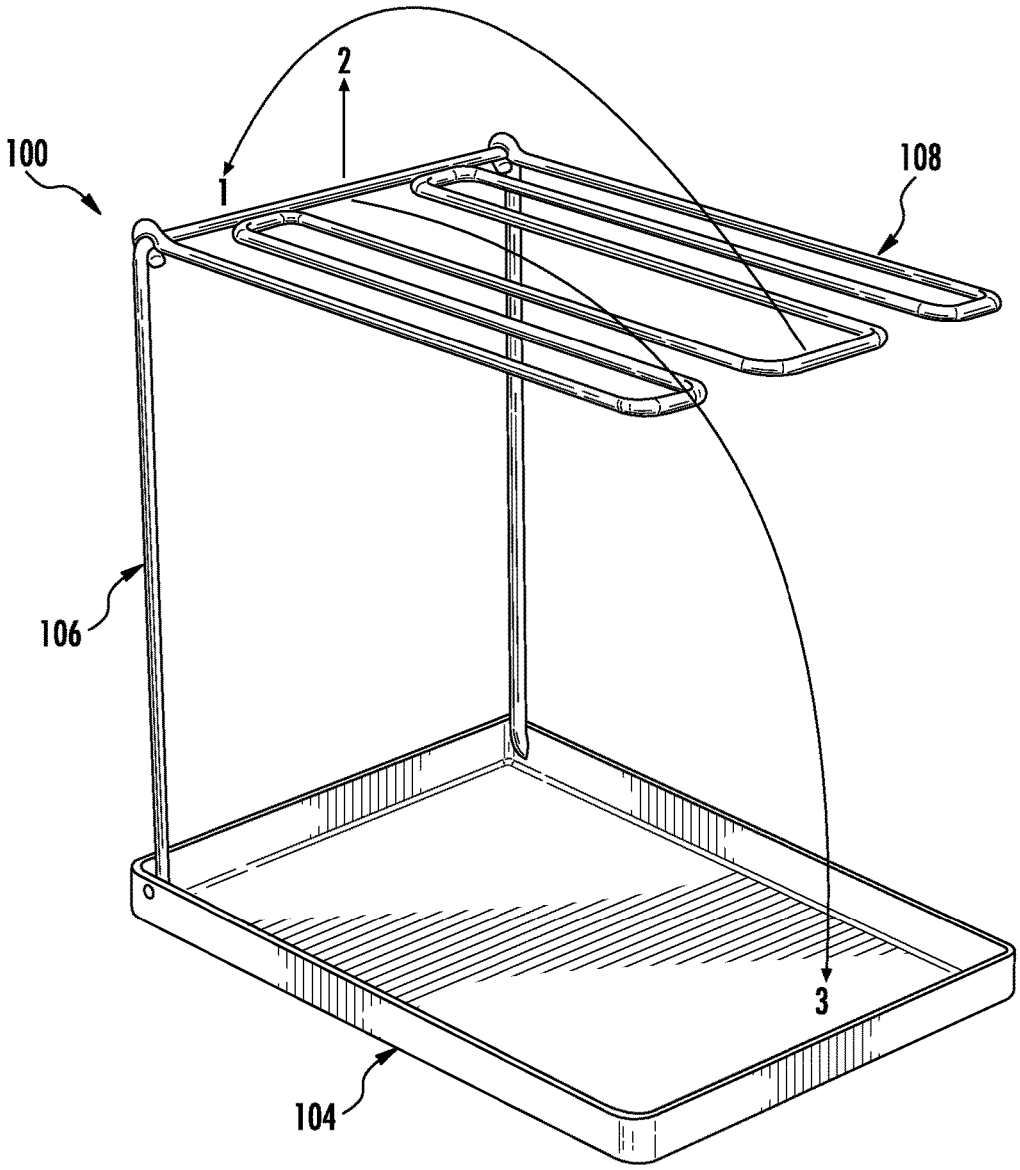
FIG. 1D is a perspective view of a wine glass drying rack in an open position with arrows indicating movement to switch from an open position to a closed position, according to the exemplary embodiment of FIG. 1A.

FIG. 1D is a perspective view of the wine glass drying rack 100 in an open position with arrows indicating movement to switch from the open position to a closed position, according to the exemplary embodiment of FIG. 1A. Arrow 1 shows the rack 108 moving upward to be rotated about support 106. The rack 108 may be able to rotate approximately 270 degrees (e.g., to 265-275 degrees) about support 106 such that the rack 108 becomes nested within the stems 118 and the top 120. Arrow 2 shows the movement of the support 106 in an upward direction to unlock the support 106 from vertical locks 114. Arrow 3 shows the rotation of the support 106 and consequently the rack 108 about the vertical locks 114 to allow the support 106 and the rack 108 to fold into a top of the tray 104. In some embodiments, the support 106 is rotated approximately 90 degrees (e.g., to 85-95 degrees) between the open position and the closed position. While the arrows are numbered, these steps do not necessary have to be conducted in this order. For example, the support 106 may be unlocked and begin being folded into the tray 104 before the rack 108 is rotated.

Figure 1E:
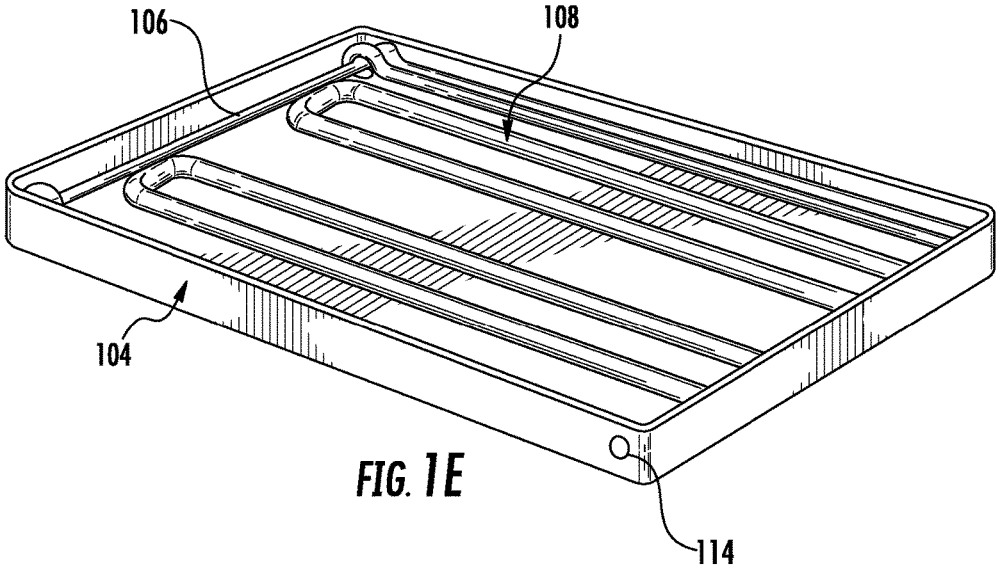
FIG. 1E is a perspective view of a wine glass drying rack in a closed position, according to the exemplary embodiment of FIG. 1A.
Figure 1F:
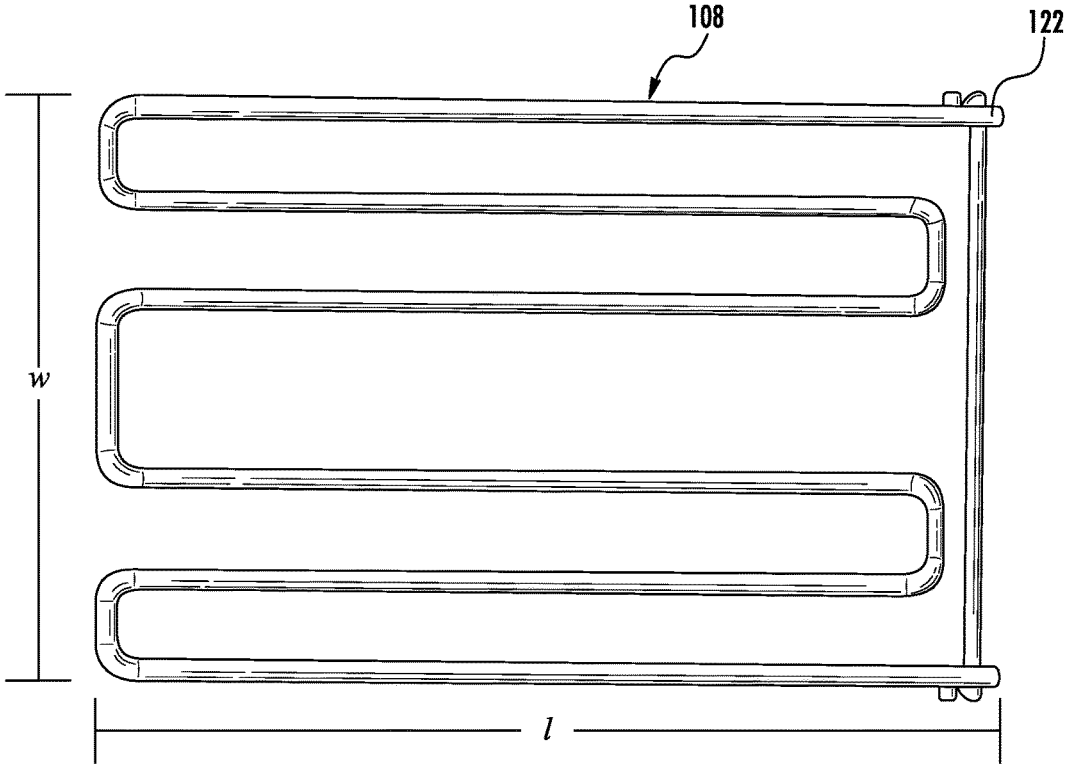
FIG. 1F is a top view of a wine glass drying rack in a closed position, according to the exemplary embodiment of FIG. 1A.

FIGS. 1E and 1F are views of the wine glass drying rack 100 in a closed position, according to an exemplary embodiment. When in the closed position, the support 106 and the rack 108 may fit completely within the tray 104. In some embodiments, the support 106 and the rack 108 are secured in the tray 104 when in the closed position. In some embodiments, the wine glass drying rack 100 may be designed such that the support 106 and the rack 108 fold into an open top of the tray 104 and rest on the tray bottom 110. The width (w) of the rack 108 may be selected such that the width (w) is smaller than a width of the tray 104. In some embodiments, the width (w) of the rack 108 and/or support 106 is approximately 7.25 inches. The length (l) of the rack 108 may be selected such that the length (l) is smaller than the tray length (tl) of the tray 104. In some embodiments, the length (l) of the rack 108 is approximately 9.5 inches.

Figure 2A:
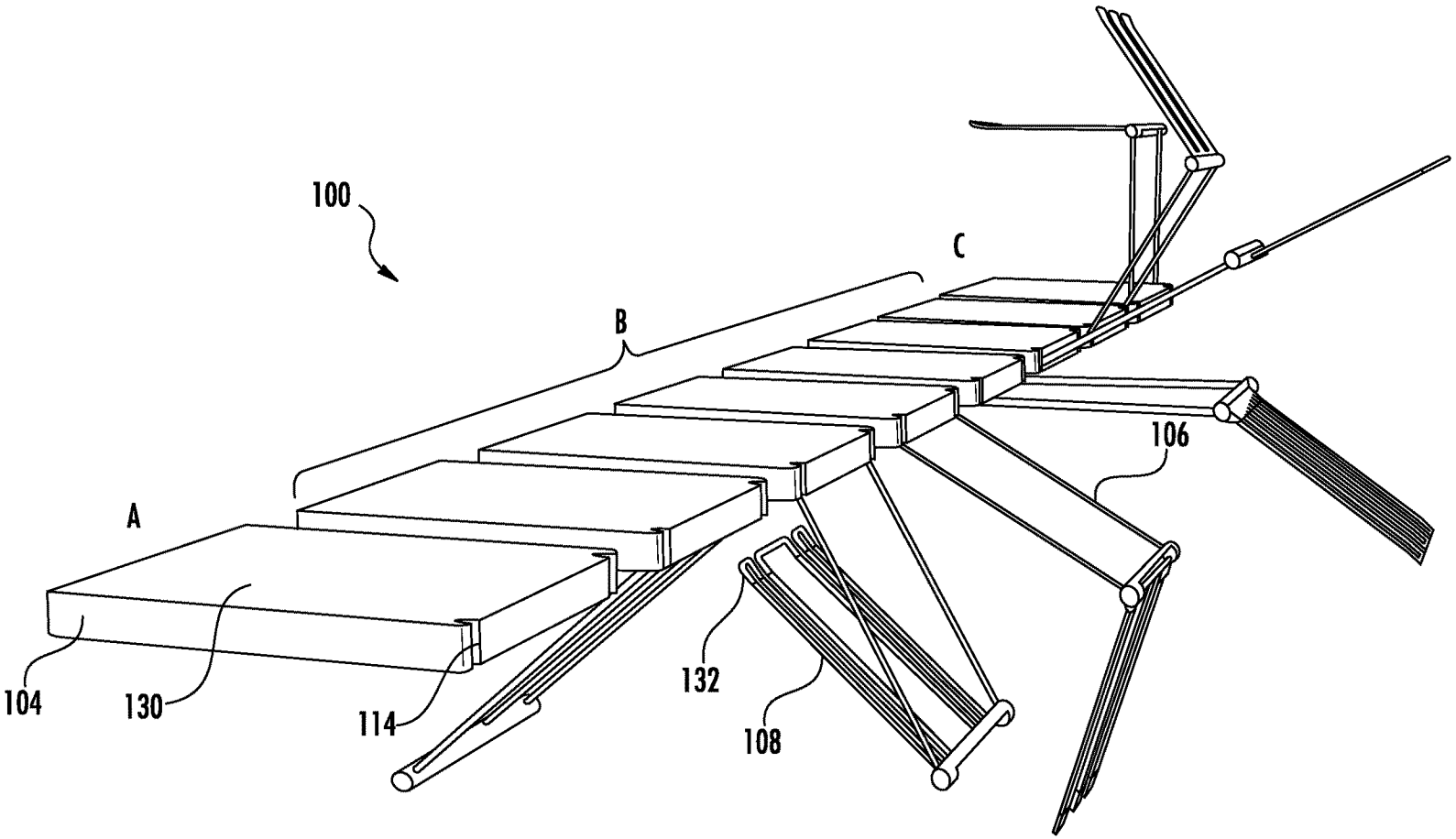
FIG. 2A is a span of perspective views of another embodiment of a wine glass drying rack moving from a closed position to an open position, according to an exemplary embodiment.

FIG. 2A is a span of perspective views of another embodiment of the wine glass drying rack 100 moving from a closed position to an open position, according to an exemplary embodiment. The wine glass drying rack 100 may start in a closed position (A) and be transitioned (B) to an open position (C) or vice versa. During the transition (B), the support 106 may be rotated about the tray 104 and the rack 108 may be rotated about the support 106 until the support 106 is locked into an upright position via the vertical locks 114 and the rack 108 is locked into a horizontal position. In some embodiments, ends of the end supports 124 and middle support 126 may be covered with a rubber cap or coating 132. When in the closed position (A), the support 106 and rack 108 may be located inside tray 104. However, in this embodiment, the support 106 and rack 108 are located under a tray top 130 instead of above the tray bottom 110, as described with reference to FIG. 1D and shown in a closed position in FIG. 1E.

Figure 2B:
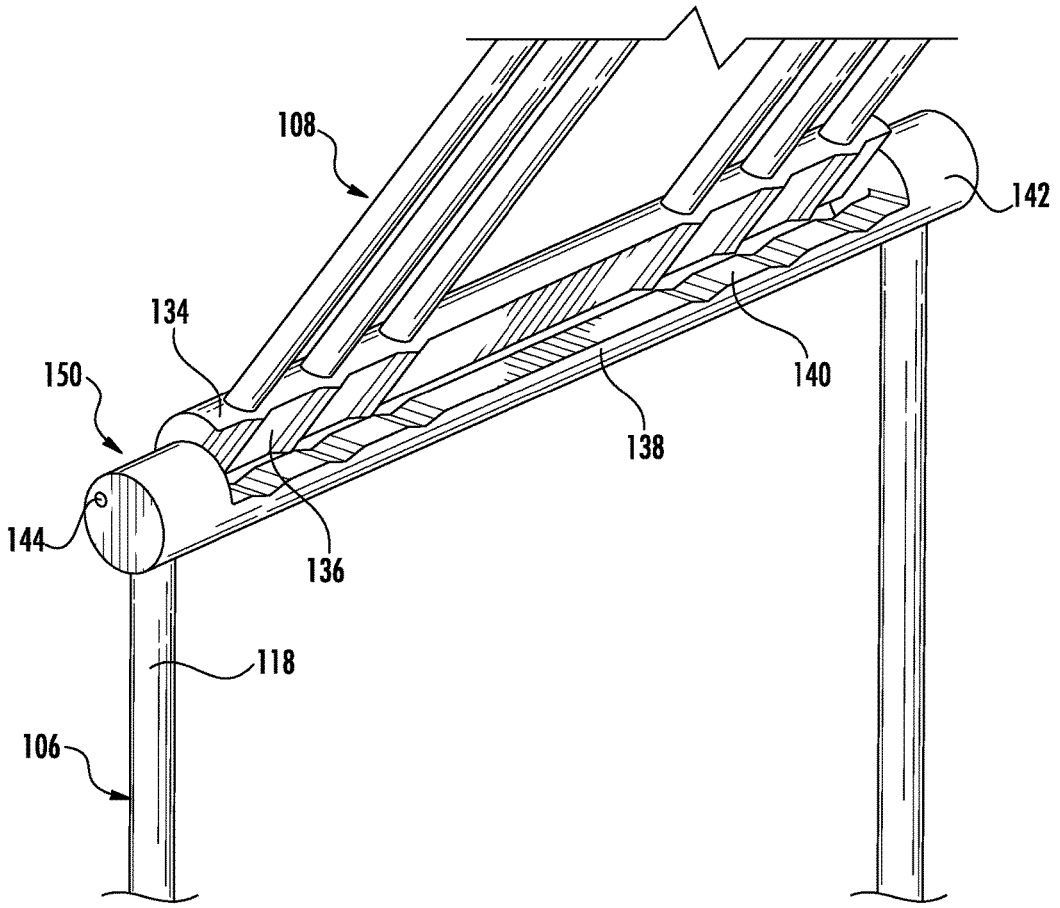
FIG. 2B is a perspective view of a rotational support mechanism of the wine glass drying rack of FIG. 2A, according to an exemplary embodiment.

FIG. 2B is a perspective view of a rotational support mechanism 150 of the support 106 and the rack 108 of the wine glass drying rack 100 of FIG. 2B, according to an exemplary embodiment. The rotational support mechanism 150 allows rotation of the rack 108 about the support 106 and secures the rack 108 in an orientation perpendicular to the support 106.

As shown in FIG. 2B, rack 108 includes a support member 134. The support member 134 extends between the stems 118 of the support 106 and defines grooves 136. Support member 134 is rotatable with respect to a support member 138 of the support 106. The support member 138 may also define grooves 140. Grooves 136 and 140 may be complementary to one another such that a flush connection is formed when the support member 134 comes into contact with the support member 138. Support member 138 is coupled to the stems 118 of the support 106 via end pieces 142. In some embodiments, end pieces 142 are cylindrical and when the support member 134 is coupled with the support member 138, a cylindrical body spans between the stems 118. The end pieces 142 also provide a rod or pin 144 that couples the support member 134 of the rack 108 to the support member 138 of the support 106 and allows rotation of the rack 108 about the rod or pin 144 to move the rack 108 between the closed position (A) and the open position (C).

Figure 2C:
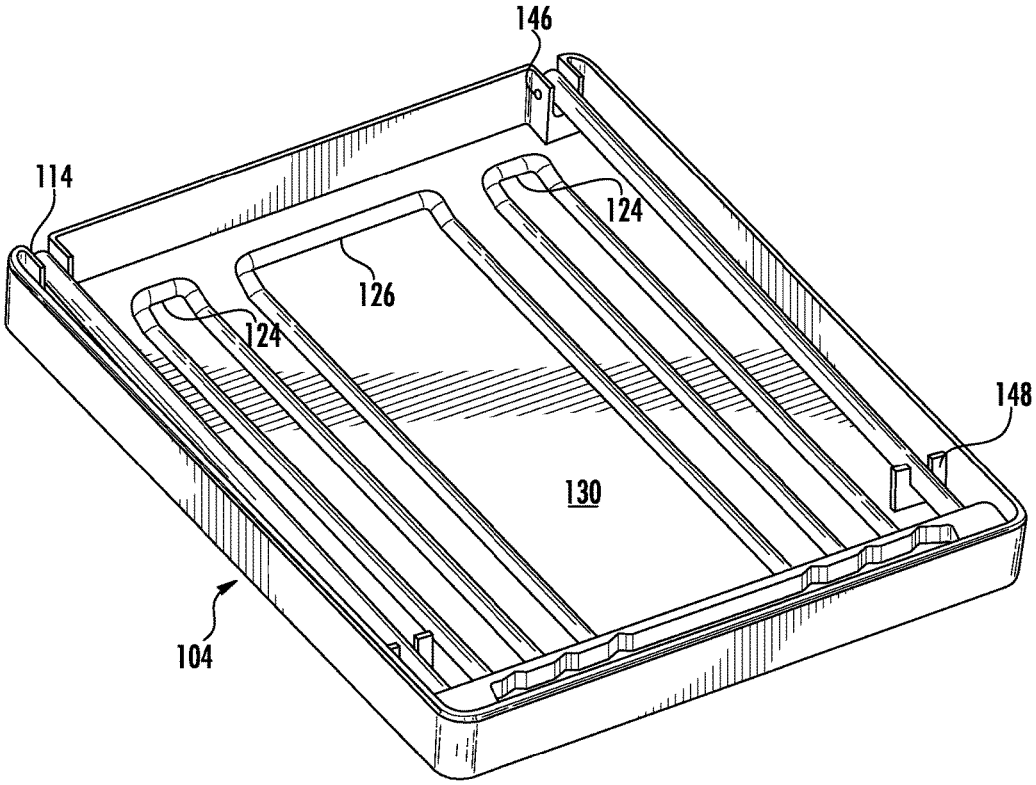
FIG. 2C is a perspective view of the wine glass drying rack in a closed position, according to the exemplary embodiment of FIG. 2A.

FIG. 2C is a perspective view of the wine glass drying rack 100 in a closed position, according to the exemplary embodiment of FIG. 2A. The embodiment shown is similar to the embodiments shown in FIGS. 2A and 2B. In some embodiments, the vertical lock 114 is a component of the tray 104 that extends inward and couples to the support 106 via a pin 146. Pin 146 allows the support 106 to rotate with respect to the tray 104. The vertical lock 114 may also define a slot, as seen in FIG. 2B, running perpendicular to the tray side 112 which secures the support 106 in a vertical position. In some embodiments, the support 106 is rotated 270 degrees (e.g., to 265-275 degrees) before being secured in the vertical position by vertical lock 114. When in the closed position, the support 106 may be locked into the tray via support lock 148. Support lock 148 may prevent the support 106 from moving or rotating when in the closed position. In some embodiments, the wine glass drying rack 100 may be designed such that the support 106 and the rack 108 fold into an open bottom of the tray 104 and rest on the tray top 130.

According to any embodiment, the wine glass drying rack may include a tray, a support and a rack. The tray may include a tray bottom or top, tray sides, vertical locks and a support lock. The support may include stems, a top, a locking element, a support member, grooves, end pieces and a rod. The rack may include loops, a support member, grooves, end supports, a middle support, slots and rubber caps. The rack may be rotatable about the support and the support may be rotatable about the tray. However, other embodiments may include or omit certain components to suit particular applications.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure.

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

The construction and arrangement of the elements of the wine glass drying rack as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the disclosure.

Other substitutions, modifications, changes and omissions may also be made in the design, operating conditions and arrangement of the various exemplary embodiments without departing from the scope of the present disclosure. For example, any element (e.g., tray, support, rack, etc.) disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the disclosure.

What is claimed is:

1. A wine glass drying assembly comprising:

a tray comprising a top, sides, and a vertical lock;

a support comprising stems and a first support member extending between the stems, wherein one of the stems is coupled to the vertical lock and wherein the support is rotatable about the vertical lock of the tray; and a rack comprising a second support member and at least two glass supports extending from the second support member, wherein the at least two glass supports define a slot for receiving wine glasses, wherein the second support member is coupled to the first support member, and wherein the rack is rotatable about the first support member;

wherein the support and rack are rotatable between an open position and a closed position, wherein in the open position, wine glasses can be received;

wherein the first support member comprising a first set of grooves and the second support member comprises a second set of grooves; and wherein the first set of grooves receives the second set of groves in the open position.

2. The wine glass drying assembly of claim 1, wherein the support is rotatable approximately 270 degrees between the open position and the closed position, and the rack is rotatable approximately 270 degrees between the open position and the closed position.

3. The wine glass drying assembly of claim 1, wherein the support and the rack fit inside of the tray in the closed position.

4. The wine glass drying assembly of claim 1, wherein the tray further comprises a support lock that is configured to be coupled to one of the stems of the support when in the closed position.

5. The wine glass drying assembly of claim 1, wherein the vertical lock comprises a slot along the tray side for locking the support in a vertical position.

6. The wine glass drying assembly of claim 1, wherein the tray further comprises a draining spout.

7. The wine glass drying assembly of claim 1, wherein the slot is sized to receive three wine glasses.

8. The wine glass drying assembly of claim 1, wherein the at least two glass supports further comprise caps.

9. The wine glass drying assembly of claim 1, wherein the first support member further comprises end pieces that each couple the first support member to one of the stems.

10. The wine glass drying assembly of claim 9, wherein the end pieces couple the first support member to the second support member via at least one of a rod or a pin.

11. A wine glass drying assembly comprising:

a tray comprising a top, sides, and a vertical lock;

a support comprising stems and a first support member extending between the stems, wherein one of the stems is coupled to the vertical lock and wherein the support is rotatable about the vertical lock of the tray; and a rack comprising a second support member and at least two glass supports extending from the second support member, wherein the at least two glass supports define a slot for receiving wine glasses, wherein the second support member is coupled to the first support member, and wherein the rack is rotatable about the first support member;

wherein the first support member further comprises end pieces that each couple the first support member to one of the stems; and wherein the end pieces couple the first support member to the second support member via at least one of a rod or a pin.

* * * * *